US010208402B2

(12) United States Patent
Zikeli et al.

(10) Patent No.: US 10,208,402 B2
(45) Date of Patent: Feb. 19, 2019

(54) SPIN BATH AND METHOD FOR CONSOLIDATION OF A SHAPED ARTICLE

(71) Applicant: AUROTEC GMBH, Vöcklabruck (AT)

(72) Inventors: Stefan Zikeli, Regau (AT); Friedrich Ecker, Timelkam (AT)

(73) Assignee: AUROTEC GMBH, Voecklabruck (AT)

( * ) Notice: Subject to any disclaimer, the term of this patent is extended or adjusted under 35 U.S.C. 154(b) by 518 days.

(21) Appl. No.: 14/434,625

(22) PCT Filed: Oct. 10, 2013

(86) PCT No.: PCT/EP2013/071135

§ 371 (c)(1),
(2) Date: Apr. 9, 2015

(87) PCT Pub. No.: WO2014/057022

PCT Pub. Date: Apr. 17, 2014

(65) Prior Publication Data

US 2015/0247261 A1 Sep. 3, 2015

(30) Foreign Application Priority Data

Oct. 10, 2012 (EP) ..... 12187870

(51) Int. Cl.
*D01D 5/06* (2006.01)
*D01F 2/00* (2006.01)

(52) U.S. Cl.
CPC *D01D 5/06* (2013.01); *D01F 2/00* (2013.01)

(58) Field of Classification Search
CPC .... D01D 5/06; D01F 2/00; D01F 2/08; D01F 2/10
See application file for complete search history.

(56) References Cited

U.S. PATENT DOCUMENTS 2,550,808 A * 5/1951 Young ..... D01D 5/06 137/565.22
2,793,396 A * 5/1957 Dooley ..... D01D 5/06 425/70

(Continued)

FOREIGN PATENT DOCUMENTS

CN 2685358 Y 3/2005
CN 201553925 U 8/2010

(Continued)

OTHER PUBLICATIONS

Firk et al., "Formatino of Lyocell-Type Fibres with Skin-Core Structure", Lenzinger Berichte, vol. 78, 1998, pp. 41-44.

(Continued)

*Primary Examiner* — Jeffrey M Wollschlager
(74) *Attorney, Agent, or Firm* — Greer, Burns & Crain, Ltd.

(57) ABSTRACT

A coagulation bath is provided with a coagulation liquid inlet, wherein the coagulation liquid inlet has one or more mouths, which are arranged beneath the coagulation liquid level of the coagulation bath; in particular a spinning bath system with a coagulation liquid inlet and an entry region for spinning yarns which are solidified in the spinning bath, wherein the entry region is provided at a position in which, when the spinning bath is filled with coagulation liquid, the liquid surface is the surface of the coagulation liquid, the coagulation liquid inlet has one or more mouths arranged beneath the entry region and are directed to spinning yarns introduced into the spinning bath such that fresh coagulation liquid flows against the spinning yarns during operation, and optionally a liquid fill level regulator and possibly further tanks with different coagulation liquid composition and methods for spinning yarns in a spinning bath.

11 Claims, 4 Drawing Sheets

(56) References Cited

U.S. PATENT DOCUMENTS 2,988,418 A * 6/1961 Finlayson ..... D01F 2/28 106/170.48
3,210,452 A * 10/1965 Howard ..... D01F 6/04 264/203
3,402,428 A * 9/1968 Schreiber ..... B29C 47/8815 425/447
3,621,088 A * 11/1971 Hatcher ..... D01D 4/02 264/178 F
3,767,756 A * 10/1973 Blades ..... D01F 6/605 264/184
3,851,036 A 11/1974 Tzentis
3,996,321 A * 12/1976 Weinberger ..... D01D 5/06 264/181
4,056,517 A 11/1977 Albers
4,070,431 A * 1/1978 Lewis ..... D01D 5/06 264/180
4,078,034 A * 3/1978 Lewis ..... D01D 5/06 264/181
4,246,221 A 1/1981 McCorsley, III
4,261,943 A 4/1981 McCorsley, III
4,298,565 A * 11/1981 Yang ..... D01D 5/06 264/181
4,340,559 A * 7/1982 Yang ..... D01D 5/06 264/181
4,416,698 A 11/1983 McCorsley, III
4,510,111 A 4/1985 Sawanishi
4,702,876 A * 10/1987 Ebregt ..... D01D 4/02 264/178 F
4,853,987 A * 8/1989 Jaworski ..... A61H 33/6063 4/509
5,216,144 A 6/1993 Eichinger et al.
5,232,756 A 8/1993 Chang et al.
5,639,484 A 6/1997 White et al.
5,984,655 A * 11/1999 Schwenninger ..... D01D 5/06 425/464
7,614,864 B2 * 11/2009 Zikeli ..... D01D 5/06 425/71
8,962,821 B2 2/2015 Zhang et al.
2011/0109008 A1 * 5/2011 Ikeda ..... D01D 5/06 264/178 F

FOREIGN PATENT DOCUMENTS

| | | |
|---|---|---|
| GB | 347878 | 5/1931 |
| GB | 679 543 | 9/1952 |
| WO | 92/04871 | 4/1992 |
| WO | 92/07124 | 4/1992 |
| WO | 03/014432 | 2/2003 |
| WO | 2006/000197 | 1/2006 |

OTHER PUBLICATIONS

Maron et al., Ergebnisse Der Verarbeitung Von TCF-Zellstoff Im Viskose- und Im Alceru-Prozess, Lenzinger Berichte, vol. 76, 1997, pp. 98-102.

Michels and Kosan, "Beitrag Zur Struktur Von Lyocellfasern, Ersponnen Aus Aminoxidhydraten Bzw. Ionischen Fluessigkeiten" Lenzinger Berichte, vol. 86, 2006, pp. 144-153.

Chinese Office Action from corresponding Chinese Patent Application No. 201380062926.7, dated Feb. 25, 2016.

* cited by examiner

SPIN BATH AND METHOD FOR CONSOLIDATION OF A SHAPED ARTICLE

BACKGROUND

The present invention relates to coagulation baths for spinning processes.

Cellulose and other polymers can be dissolved in suitable solvents and transferred by controlled solidification into a desired shaped article. If this shaped article is a yarn, fibril or the like, reference is also made to a spinning process. Cellulose is dissolved for example in aqueous solutions of amine oxides, in particular of solutions of N-methylmorpholine N-oxide (NMMO), in order to produce spinning products, such as filaments, staple fibres, films, etc., from the obtained spinning solution. This occurs by precipitation of the extrudates in water or diluted amine oxide solutions once the extrudates of the extrusion die are guided via an air gap into the precipitation bath.

U.S. Pat. No. 4,416,698 relates to an extrusion or spinning method for cellulose solutions in order to shape cellulose into yarns. In this case, a fluid spinning material—a solution of cellulose and NMMO (N-methylmorpholine N-oxide) or other tertiary amines—is shaped by extrusion and solidified and expanded in a precipitation bath. This method is also known as the "lyocell" method.

U.S. Pat. No. 4,246,221 and DE 2913589 describe methods for producing cellulose filaments or films, wherein the cellulose is drawn in fluid form. These documents describe a spinning process in which cellulose is dissolved in tertiary amine oxide, wherein the obtained cellulose solution is pressed via a die, is extruded via an air gap into a spinning funnel, and is discharged at the end of the spinning funnel in the form of continuous yarn. The spinning funnel used is equipped with a feed means and a removal means for the spinning bath.

U.S. Pat. No. 4,261,943 relates to a method for producing shaped cellulose articles, wherein the surface of the spun yarns is treated with a non-solvent.

A further method is described in U.S. Pat. No. 5,252,284, in which elongate shaping capillaries are used to shape a cellulose material.

WO 92/07124 describes a method for producing a cellulose fibre with reduced tendency to fibrillation. The undried fibre is in this case treated with a cationic polymer.

WO 93/19230 A1 describes a further development of the lyocell method, in which the cellulose-containing spinning material is cooled immediately after the shaping process before introduction into the precipitation bath.

WO 94/28218 A1 describes a method for producing cellulose filaments, in which a cellulose solution is shaped into a number of strands via a die. These strands are introduced into a precipitation bath through a gap around which gas flows and are discharged continuously.

DE 555183 relates to spinning vessels for wet spinning, wherein a spinning yarn runs perpendicularly through a number of baths.

WO 92/4871 describes a method for producing a cellulose fibre with reduced tendency to fibrillation. The reduced fibrillation is achieved in that all baths with which the fibre comes into contact before the first drying must have a pH value of at most 8.5. This control in a continuous-flow bath is very complicated and requires chemicals for pH control.

CA 2057133 A1 describes a method for producing cellulose yarns, wherein a spinning material is extruded and is introduced via an air gap into a cooled water bath containing NMMO. To regulate the NMMO constituents, the water bath contains a circuit for bath liquid regeneration with a spinning bath feed and an outlet.

WO 03/014432 A1 describes a precipitation bath with a central device for removing the spinning yarn below a covering film.

DE 10 2004 031 025 B3 discloses a spinning device with a spinning bath containing an inflow chamber for spinning bath liquid, designed to create a laminar spinning bath flow. In this context, a baffle plate is provided for the purpose of preventing the spinning yarns from running into the spinning bath.

EP 1 900 860 A1 describes a 2-step coagulation bath of a spinning device, wherein the baths may contain $H_2SO_4$ in different compositions.

U.S. Pat. No. 4,510,111 A relates to a method for producing acrylic yarns, in which a spinning solution is introduced into a first bath immediately, without an air gap.

U.S. Pat. No. 3,851,036 A relates to a spinning method for hollow fibres made from acrylonitriles that can be obtained in a spinning process and by passing them through a plurality of baths.

GB 679 543 A describes a viscose spinning method in a solution counterflow with variable composition.

U.S. Pat. No. 4,056,517 A relates to the spinning of modacrylic copolymers, wherein the spinning yarns are passed through a plurality of baths.

Maron et al. (Lenzinger Berichte, 76 (1997) 98-102), besides the raw material selection, also concerns the coagulation conditions and the influence thereof on NMMO fibres. It is demonstrated that, with highly varying spinning bath concentrations, there is only a very small influence on fibre strength.

Michels and Kosan (Lenzinger Berichte, 86 (2006) 144-153) concerns the coagulation process of cellulose fibres with or without addition of additives formed from spinning solutions consisting of NMMO liquids or ionic liquids. The objective of these examinations is to determine the water retention capacity and the strength of the resultant fibres. The strength of the produced fibres, in accordance with the examples, is largely independent of the solvent used, however additive components (mixed with cellulose) generally cause a considerable decrease in strength. The examples also demonstrate a considerable influence on the water retention capacity of the "never dried" fibre. However, these differences are balanced out to the largest possible extent by one-time drying.

Fink et al. (Lenzinger Berichte, 78 (1998) 41-44) concerns the use of a two-stage precipitation process with use of different precipitants (first stage alcohol, second stage water or aqueous NMMO). Due to this measure, a "skin core" effect is to be achieved, which is to lead to a reduced tendency to fibrillation of the lyocell fibres.

SUMMARY

An object of the present invention is to provide optimised precipitation baths for spinning processes in order to selectively influence the fibre properties, in particular the tendency to fibrillation and the swelling of the fibres. A further object is to enable precise control of the precipitation bath composition—also because solvents for cellulose used in the lyocell method, such as NMMO and the like, are costly—and to utilise or to recover the solvents efficiently.

The invention relates to a coagulation bath with a coagulation liquid inlet, wherein the coagulation liquid inlet has one or more mouths, which are arranged beneath the coagulation liquid level of the coagulation bath, or wherein at least one coagulation liquid inlet is arranged beneath the coagulation liquid level of the coagulation bath. The present invention is further presented by further aspects and described by methods in which the devices according to the invention are used and can all be combined with one another. The invention is also defined as presented in the claims. In accordance with the invention, the extension of the shaped article is controlled optimally by the gentle and controlled precipitation in each aspect of the invention.

The present invention provides a coagulation bath with a coagulation liquid inlet and an entry region for shaped articles which are solidified in the coagulation bath, wherein the entry region is provided at a position in which, in the case of a coagulation bath filled with coagulation liquid, the liquid surface is the liquid surface of the coagulation liquid, wherein the coagulation liquid inlet has one or more mouths arranged beneath the entry region and directed to shaped articles introduced into the coagulation bath, such that fed or fresh coagulation liquid flows against the shaped articles during operation.

The shaped articles according to the invention are preferably spinning yarns. In accordance with the invention, the coagulation bath is therefore also referred to as a spinning bath. "Spinning bath" and "coagulation bath" are used interchangeably herein. The shaped articles may also be films or other shaped articles of any cross section. The shaped articles are usually shaped continuously by extrusion and are therefore also referred to as endless shaped articles of indeterminate length.

More specifically, the present invention relates to a spinning bath with a coagulation liquid inlet and an entry region for spinning yarns which are solidified in the spinning bath, wherein the entry region is provided at a position in which, in the case of a spinning bath filled with coagulation liquid, the liquid surface is the liquid surface of the coagulation liquid, characterised in that the coagulation liquid inlet has one or more mouths arranged beneath the entry region and directed to spinning yarns introduced in the spinning bath, such that fed coagulation liquid flows against the spinning yarns during operation.

A spinning bath according to the invention is usually positioned beneath an extrusion device, in which the shaped articles or spinning yarns, which are still fluid, are extruded. In the lyocell method, the spinning yarns pass through an air gap, in which air may optionally flow against the yarns, and then reach the spinning bath. The height of the air gap may be between 5 mm and 40 mm for example, in particular between 10 mm and 30 mm. The shaped articles or spinning yarns can be drawn in the air gap, which improves the textile properties of the obtained solidified products in some cases. In accordance with the invention, the drawing is optional and may or may not be carried out. At a specific position in the spinning bath, the shaped articles enter the bath and coagulate in a manner determined by the coagulation liquid, which is usually a non-solvent of the shaped article material. The shaped article material is preferably cellulose. Spinning baths usually have a coagulation liquid inlet for renewal of the coagulation liquid in the spinning bath. Since the shaped articles contain solvents, the composition of the spinning bath could be changed without controlled feed, whereby a coagulation property varying over time could compromise the consistency of the shaped articles. Coagulation liquid is normally discharged with the shaped articles from the bath. The bath may also have a separate outlet for coagulation liquid.

The flow of coagulation liquid against the fluid shaped articles serves for the exchange of solvent and non-solvent between the fluid shaped articles and the coagulation bath and can be implemented via different devices.

In accordance with the first aspect of the present invention, the mouths of the coagulation liquid inlet are positioned within the spinning bath, more specifically beneath the entry region of the shaped articles. The mouths are specifically directed to shaped articles introduced into the coagulation bath, such that coagulation liquid flows against the shaped articles during operation. Constant coagulation conditions are thus created, whereby consistency is increased and precise control of the coagulation conditions is possible, for example in order to influence the tendency to fibrillation as desired. For example, it is preferable if, in this stage, the shaped articles do not coagulate totally in a sudden manner, but if only the surface is coagulated. In a further stage, after the region in which coagulation liquid flows against the shaped articles, the yarns are further or completely solidified by expulsion of the solvent. In the meantime, the yarns may remain in a gel-like state. This second stage may occur still in this first spinning bath or in a further, separate spinning bath.

The mouths of the coagulation liquid inlet, in preferred embodiments, are directed from the side to the shaped articles, for example spinning yarns, in the spinning bath. The fact that coagulation liquid flows from the side against the shaped articles means that the shaped articles pass through the spinning bath in an unhindered manner, wherein, due to the flow of coagulation liquid against the shaped articles, fed or fresh coagulation liquid is entrained by the yarns. The coagulation is thus implemented under controlled conditions at least at the surface of the shaped articles.

The mouths are preferably arranged centrally in the spinning bath, in particular preferably with horizontal orientation. The exact position in the spinning bath is not fundamental here, however a distinction is made between a position at the edge of the spinning bath, which is not suitable or is only slightly suitable to a negligible extent for a direct flow of coagulation liquid against the shaped articles in order to achieve the effects according to the invention.

The mouths of the liquid feed line, in preferred embodiments, are directed (upwardly) at an incline against the direction of extrusion of the spinning yarns or in the direction of the liquid surface of the spinning bath, but may also be directed perpendicular to the direction of extrusion of the filaments or even at an incline downwardly (in the direction of extrusion). A horizontal or level arrangement (for example substantially parallel to the liquid surface) is also possible. The angle between the direction of transport/direction of extrusion of the shaped articles and the direction of flow of the fed coagulation liquid at the mouths is preferably between −90° (downwardly) and +90° (upwardly), or between −40° (downwardly) and 80° (upwardly), in particular preferably between −30° and 70°, specifically preferably between −25° and 65°, between −30° and 60°, or between −35° and 55°.

In a further embodiment, further liquid feed lines may also be attached in addition to a first liquid feed line and are positioned both beneath and above the liquid surface and are supplied either jointly with the first liquid feed line or are fed separately.

In further preferred embodiments, the mouths are positioned at a distance of 1 mm to 50 mm from the shaped articles transported through the coagulation bath. The distance is the geometrically minimum distance, for example determined by a normal to the direction of spinning (direction of extrusion) or the direction in which the shaped articles are removed through the spinning bath (for example drawn via a deflection pulley). The distance is specifically preferably from 2 mm to 45 mm, from 3 mm to 40 mm, from 4 mm to 35 mm, from 5 mm to 30 mm, from 6 mm to 25 mm, from 7 mm to 20 mm, or from 8 mm to 15 mm. Due to a short distance, a mixing of the fed coagulation liquid with coagulation liquid already located in the spinning bath, which is mixed with solvents introduced by the shaped articles, is reduced.

To reduce the mixing of the two coagulation liquids, diversion elements may also be provided in the spinning bath in the region of the mouths. The diversion elements shield the flow of the fed coagulation liquid onto the shaped articles introduced into the spinning bath, in particular in said entry region at the surface of the coagulation liquid, before the inflow of coagulation liquid located in the spinning bath.

The mouths are provided beneath the surface (also referred to as the level) of the coagulation liquid in the spinning bath and in this function are also suitable for providing an external regulation of the fill level of the coagulation liquid in the spinning bath. The mouths are preferably 1 mm to 500 mm beneath the surface or the level, in particularly preferred embodiments 2 mm to 400 mm, 3 mm to 300 mm, 4 mm to 250 mm, 5 mm to 200 mm, 6 mm to 150 mm, 8 mm to 100 mm, 10 mm to 80 mm, 12 mm to 60 mm, 14 mm to 40 mm, or also 15 mm to 30 mm beneath the surface or the level of the coagulation liquid in the spinning bath. The mouths are preferably located in vertical alignment in the upper half of the coagulation liquid level necessary for operation.

In combination with all aspects of the invention, the surface of the coagulation liquid is largely in direct contact with the gas (particularly air) of the air gap, that is to say the coagulation liquid is not covered by a film. Alternatively, a covering layer may also be applied over the surface of the spinning bath. Also preferably, the coagulation liquid is not divided horizontally into two zones, but instead forms a single medium in the spinning bath that can be intermixed by means of convection.

In a second aspect of the present invention, a coagulation bath with a liquid container, for example a tank, is provided, with a liquid line into the liquid container with one or more mouths beneath a predetermined liquid level in the liquid container, and a liquid fill level regulator outside the liquid container, which is hydraulically connected via the liquid line to the liquid in the liquid container, wherein the liquid fill level regulator contains an opening at a predefined level. The liquid level in the liquid container is thus established in the manner of a communicating vessel with the externally arranged liquid fill level regulator, or the liquid level in the liquid container is determined by the hydraulic connection.

In accordance with the invention, a liquid fill level regulator is provided outside the liquid container of the coagulation bath (also referred to herein as a spinning bath) filled with coagulation liquid. Spinning baths usually have a coagulation liquid inlet in order to balance out at least the liquid container by the entrained transport with the shaped articles transported through the spinning bath. For intensified renewal of the liquid, the spinning bath may optionally also have a separate liquid outlet. A separate liquid outlet (irrespective of the liquid discharged with the spinning yarns ("drag losses")—this is not referred to herein as a liquid outlet) is preferably not provided in the spinning bath however. The coagulation liquid is generally contaminated by various substances, solvents and non-solvents of the shaped article material or other substances of the production process. Contaminating substances may for example be metal ions, which can detach from the extrusion equipment (for example made of steel, stainless steel, ceramic, sintered metals, aluminium, plastic, non-ferrous metals or noble metals). Preferred metals are all irons, iron alloys, chromium-nickel steels and nickel steels (for example Hastelloy materials, titanium and tantalum).

Due to the external liquid fill level regulator, a possibility is provided to feed only as much liquid to the spinning bath as is removed from the coagulation container due to the drag losses, caused by the removed filament band. This allows a particularly gentle and turbulent-free supply of the coagulation region with coagulation liquid.

In addition, this allows an overflow, which is provided by the opening in the regulator, to be kept externally of the spinning bath and therefore kept free from contaminations or coagulation liquid composition changes that would otherwise occur during spinning process. To this end, the liquid fill level regulator is preferably combined with the liquid inlet. To this end, the liquid fill level regulator comprises the liquid inlet. The quantity of the inflow into the bath is thus controlled in the liquid fill level regulator via the position of the opening and therefore of the fill level in the bath. A line from the liquid fill level regulator into the spinning bath then conveys the coagulation liquid into the spinning bath. The line runs into the bath in particular beneath the coagulation liquid level as described above—in particular in order to provide the hydraulic connection to the liquid fill level regulator, but also in preferred embodiments as described above so as to provide a flow of fed (fresh) coagulation liquid directly against the shaped articles entering the spinning bath. The liquid line therefore preferably leads into the interior of the liquid container, for example a tank, wherein the mouths are arranged in the interior of the liquid container. The mouths are in particular preferably central, that is to say are not arranged at the edge of the liquid container as described above.

The height of the opening in the liquid fill level regulator is preferably adjustable. For example, the height of the opening can be height-adjustable by rotation of a rotatable element. Due to the height adjustment, the level differences may vary for example from 5 mm to 200 mm, preferably from 10 mm to 150 mm, from 15 mm to 100 mm, or from 20 mm to 50 mm.

The overflow from the opening can be used in order to feed a subsequent washing stage. A subsequent washing stage may be a further bath, into which the shaped articles are introduced after coagulation.

In a further aspect, the invention relates to a coagulation bath device with at least one coagulation liquid container and a subsequent washing container, with a first liquid container ("coagulation liquid container") with a first coagulation liquid, and a second liquid container ("washing container") with a second coagulation liquid, and with a shaped article deflection device for conveying shaped articles from the coagulation container into the washing container, wherein the first coagulation liquid may have a concentration of coagulation agents different from the second coagulation liquid and/or may have a different temperature. This aspect can of course also be combined with all previously mentioned features of the first and second aspect of the invention, wherein the first liquid container or its fill level regulator may in particular be designed as described above.

The coagulation liquid container in combination with the subsequent washing container, for example in each case formed as tanks, can be used in order to produce different coagulation conditions. For example, in the first container, only the surface of the shaped articles may be solidified, and complete solidification may be performed in the second container (for example by completely washing out the solvents remaining in the shaped article). In the liquid, the solvent quantities behave reciprocally in relation to the quantity of coagulation agents. A higher solvent concentration or a lower coagulation agent concentration is preferably provided in the first container compared to the second container or vice versa. Depending on the coagulation agent concentration, a gentle or rapid coagulation can be performed in the first and/or second container. Product parameters such as fibrillation can thus be influenced in a controlled manner, depending on shaped article form and cross-sectional dimension.

The concentration of solvent, for example a tertiary amine oxide, in particular preferably NMMO, in the first coagulation bath is preferably in the range from 15% to 50%, preferably from 20% to 40% (all amounts in % are in % by weight). Shock precipitation preferably does not occur in the first bath, but rather a gentle precipitation, for example due to the presence of solvent. In this case, the shaped articles in particular are only coagulated incompletely, that is to say are not coagulated through to the core. In accordance with the invention, the extension of the shaped article is controlled optimally by the gentle and controlled precipitation in each aspect of the invention.

Due to the use of different coagulation baths, different treatments of the shaped articles can be achieved. The shaped articles are preferably not completely solidified in the first coagulation bath, but are transferred into a gel-like state. The shaped articles are preferably also drawn in the first coagulation bath, which, due to the different degrees of coagulation in the inner and outer region of the shaped articles, results in particularly interesting properties of the obtained finished shaped article, specifically in the case of yarns.

In preferred embodiments, the second liquid container has a liquid inlet separate from the first liquid container.

The second liquid container may have a liquid outlet separate from the shaped article discharge. The liquid outlet may be an overflow. The liquid that is dragged out from the first coagulation container by the shaped articles, such as a filament bundle, is preferably introduced into the second liquid container. Costly solvents or coagulation liquids can thus be reused efficiently.

The liquid inflow of the first and/or second liquid container outside the liquid container is preferably provided with an externally arranged liquid fill level regulator, in particular as already described above.

The invention further relates to methods for solidifying shaped articles with use of any of the coagulation baths or devices described herein.

In particular, the invention relates to a method for solidifying shaped articles, wherein the fluid shaped articles are guided into a coagulation bath with a coagulation liquid, wherein, in the coagulation bath, coagulation liquid fed into the coagulation bath flows against the shaped articles. To this end, coagulation liquid lines may discharge into the coagulation bath, such that the mouths are directed to the shaped articles, as already described herein.

The invention also relates to a method for solidifying shaped articles, wherein the fluid shaped articles are guided into a coagulation bath with a liquid container with a coagulation liquid, wherein the level of the coagulation liquid is predefined by a liquid fill level regulator located outside the liquid container, preferably with an external liquid fill level regulator as described above. Coagulation liquid fed into the bath is preferably fed via the liquid fill level regulator. The liquid is first conveyed into the regulator and connected to the bath by a further line via a hydraulic connection. Due to this connection, liquid flows from the regulator into the bath depending on the fill level in the bath for liquid balancing with the level of the opening.

The invention further relates to a method for solidifying shaped articles in a coagulation bath device with at least two liquid containers (for example tanks) separated from one another, wherein shaped articles are partly solidified in a first liquid container and are conveyed into a second liquid container, preferably once output from the first liquid container via a deflection and/or bundling device, and the shaped articles are additionally washed out and further solidified in the second liquid container. Different conditions can be established in the two or more liquid containers, in particular shaped articles melting at high temperature can be cooled and solidified in two controlled stages as a result of different temperatures. In the case of solutions, the solvents from the shaped articles can be washed out from the shaped articles in at least two stages under different conditions.

To shape the shaped articles, the exit openings on the extruder can be selected in any form. Elongate openings for shaping films or small, round openings for shaping filaments or yarns are possible. The openings are preferably at most 2 mm, at most 1.5 mm, at most 1.2 mm, at most 1.1 mm, or at most 1 mm narrow or in diameter. The openings may be at least 0.1 mm, at least 0.2 mm, at least 0.3 mm, at least 0.4 mm, at least 0.5 mm, at least 0.6 mm, at least 0.7 mm, at least 0.8 mm, or at least 0.9 mm narrow or in diameter. After the exit, the material is indeed in the shaped state, but is still in fluid phase.

A plurality of extrusion openings are preferably provided side by side on the extruder or plurality of shaped articles. The extrusion openings may be provided on an arched, that is to say curved, extrusion plate, wherein the angle of curvature a at the edge of the extrusion plate is preferably an acute angle to the extruder direction. The angle of curvature a is preferably smaller than 85°, in particular smaller than 80°, smaller than 75°, smaller than 70°, smaller than 65°, smaller than 60° or smaller than 55°. Due to a curvature, the profile of the mounting of the extrusion openings can be adapted to the profile of the surface of a liquid in the coagulation bath. By inflow of the shaped articles into the coagulation bath, the surface of the liquid there is curved, whereby, with flat guidance of the extrusion openings, the middle shaped articles require a longer travel time than those arranged to the outside. Inhomogeneities caused by different residence times in the gas column may thus be produced. These are avoided in accordance with the invention.

Media, liquids and/or temperatures in/at which the shaped articles solidify can be provided in the coagulation bath. For example, liquids or solutions can be used in which the material is not soluble and therefore precipitates. Alternatively or additionally, low temperatures can be selected, at which the material solidifies. Due to an at least intermittent continuous precipitation, the shaped articles according to the invention, for example filaments, yarns or films, can be produced. The shaped articles can be discharged continuously or discontinuously from the coagulation bath. The liquid in the coagulation bath can also be renewed continuously or discontinuously. The temperature of the collecting bath can be controlled to a specific temperature, for example by heating or cooling elements or by control of the medium change.

The shaped articles (for example spinning yarns or fibres) may consist of a thermoplastic material, in particular of a viscous fluid, which is solidified in the coagulation bath. The material is preferably selected from cellulose solutions, fluids capable of hardening, in particular "hot-melts", such as polymers, polycarbonates, polyesters, polyamides, polylactic acid, polypropylene, etc. Cellulose solutions are in particular cellulose/amine oxide solutions, specifically solutions of tertiary amine oxide solutions. An example is a cellulose/NMMO (N-methylmorpholine N-oxide) solution, as described in U.S. Pat. No. 4,416,698 or WO 03/057951 A1. Cellulose solutions in the range from 4% to 23% cellulose are preferably used for the processing into extrusion products. The shaped articles, before solidification in a coagulation liquid, preferably contain dissolved cellulose. The solution may be a mixture of water and a tertiary amine oxide, such as NMMO, in particular preferably aqueous solutions. The solvent, for example NMMO, should be contained in the spinning bath (or baths) in a low concentration sufficient for precipitation of cellulose. The solvent is introduced by means of the shaped articles into the spinning bath or spinning baths and, by renewal of the coagulation liquid through the inlet, should be kept at a sufficiently low proportion in order to achieve the desired degree of coagulation in the respective spinning bath.

The solution of the shaped article material may be an aqueous solution. The solution may be a thixotropic fluid, in particular a spinning solution. The spinning solution may contain NMMO and cellulose, wherein the mass ratio of NMMO to cellulose is between 12 and 3, preferably between 10 and 4, or further preferably between 9 and 5.

The mass ratio a) ("input") of NMMO to cellulose in the shaped article before introduction into the coagulation liquid is especially preferably between 12 and 3, preferably between 10 and 4, or between 9 and 5. Alternatively or in combination, the mass ratio b) ("output") of NMMO adhering in and to the shaped article to cellulose in the shaped article upon output from the (first) coagulation bath is in preferred embodiments between 10 and 0.5, preferably between 8 and 1, in particular between 6 and 3. The ratio of the mass ratios a) and b) ("input:output"), wherein the mass ratios a) and b) are as defined above, is particularly preferably between 0.2 and 25, preferably between 0.3 and 10, in particular between 0.5 and 3. The mass ratios NMMO to cellulose in the shaped article can be selected by appropriate mixing of the substances (before extrusion and, associated therewith, before introduction into the coagulation bath). The output mass ratio b) can be controlled by the NMMO quantity in the coagulation liquid and/or the flow rate and the discharge rate of the shaped articles and also in particular by devices for wiping off or draining off liquid adhering to the shaped article. "NMMO adhering in or to the shaped article" is to be understood such that the shaped article, after the treatment in the coagulation bath, still contains solvent, particularly in the core, and has only been coagulated at the surface ("in") and liquid of the coagulation bath possibly adheres to the shaped article ("on"). Coagulation liquid, particularly of the first bath, may still comprise relatively high quantities of solvent (NMMO). In particular if the shaped article forms a filament bundle, high quantities of liquid may also be carried. These quantities of discharged liquid are preferably counterbalanced by a feed via the coagulation liquid inlet. If the ratio a:b is >1, NMMO must additionally be fed to the coagulation liquid, since the NMMO quantity fed via the fluidised shaped articles is not sufficient for export and the NMMO quantity in the bath would otherwise decrease (which is also a less preferred, yet still possible, embodiment). The additional NMMO feed is preferably undertaken via the coagulation liquid inflow.

With discharge of NMMO from the coagulation bath via the shaped articles, it is possible to dispense with another liquid outlet.

Specific materials have a melting point of at least approximately 40° C., at least 50° C., at least 55° C., at least 60° C., at least 65° C., at least 70° C., or at least 75° C. The material can be extruded and conveyed into the coagulation bath at exemplary temperatures of at least approximately 40° C., at least 50° C., at least 55° C., at least 60° C., at least 65° C., at least 70° C., at least 75° C., at least approximately 80° C., at least 85° C., at least 90° C., or at least 95° C. The zero shear viscosity of the fluid is preferably in the range from 100 Pas to 20,000 Pas, in particular between 500 Pas to 16,000 Pas.

The temperature of the first and/or second coagulation bath is preferably between 5° C. and 60° C., in particular preferably between 10° C. and 50° C., or between 15° C. and 40° C. In specific embodiments, the temperature of the second coagulation bath is cooler than the first coagulation bath by at least 1° C., preferably by at least 5° C.

The shaped articles can be discharged from the coagulation bath (or baths) via a deflection and/or bundling element, for example a deflection pulley (fixed or rotating). In preferred embodiments, the discharge rate for removal of the shaped articles from the first or second coagulation bath—which can be selected independently of one another—is between 5 m/min and 100 m/min, in particular preferably between 10 m/min and 80 m/min, particularly preferably between 20 m/min and 60 m/min, especially between 25 m/min and 50 m/min.

Additives for obtaining specific product properties can be added in the first and/or second coagulation bath. For example, crosslinking agents, emulsifiers, surfactants, detergents or also colorants or dyes (including "colourless" dyes) can be added. The shaped articles may be subjected to a treatment with an emulsifiable polymer, such as polyethylene or polyvinyl acetate, or also a crosslinking with glyoxal. The reduction in the tendency to fibrillation of solvent-spun cellulosic shaped articles can be achieved with bireactive dyes, glyoxal, a glycol, glycol ether, polyglycol, polyglycol ether, alcohols such as isoamyl alcohol, isobutanol or isopropanol.

To retain the coagulation liquids when removing the shaped articles from the baths, the baths may have wipe-off lips.

In addition, the invention relates a shaped article obtainable or produced by one of the methods according to the invention.

BRIEF DESCRIPTION OF THE DRAWINGS

The present invention is further explained by the following figures and examples without being limited to these embodiments of the invention.

DETAILED DESCRIPTION

Examples

Figure 1:
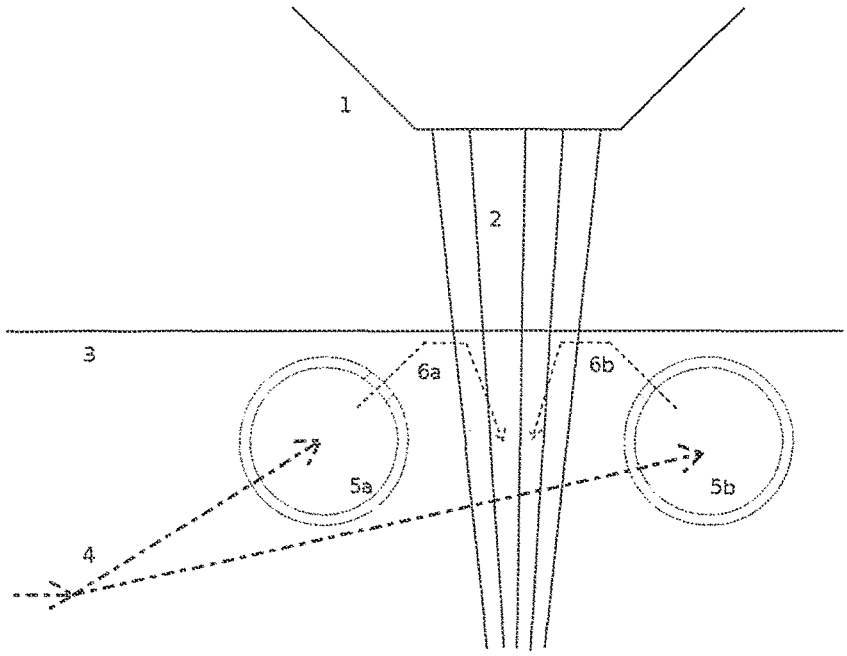
FIG. 1 shows an arrangement of the coagulation liquid inlet according to the invention in a spinning bath. Spinning yarns 2 or other shaped articles are extruded from an extrusion device 1 and reach a spinning bath via an air gap. The coagulation liquid surface or the level is denoted by reference sign 3. The entry region of the spinning yarns in the bath is arranged between the points of intersection of the lines 2 and 3. A coagulation liquid inlet is provided in the spinning bath and is fed through a line (schematically illustrated by 4). The coagulation liquid is introduced into the spinning bath through distributing pipes 5*a* and 5*b*, illustrated in cross section, via mouths 6*a* and 6*b* in the direction of the spinning yarns. The flow of the fresh coagulation liquid is marked by the thin dashed lines. It is entrained by the flow of the spinning yarns. Additional liquid inlets with accordingly formed mouths can be attached both above and beneath the level of the coagulation liquid surface.
Figure 2:
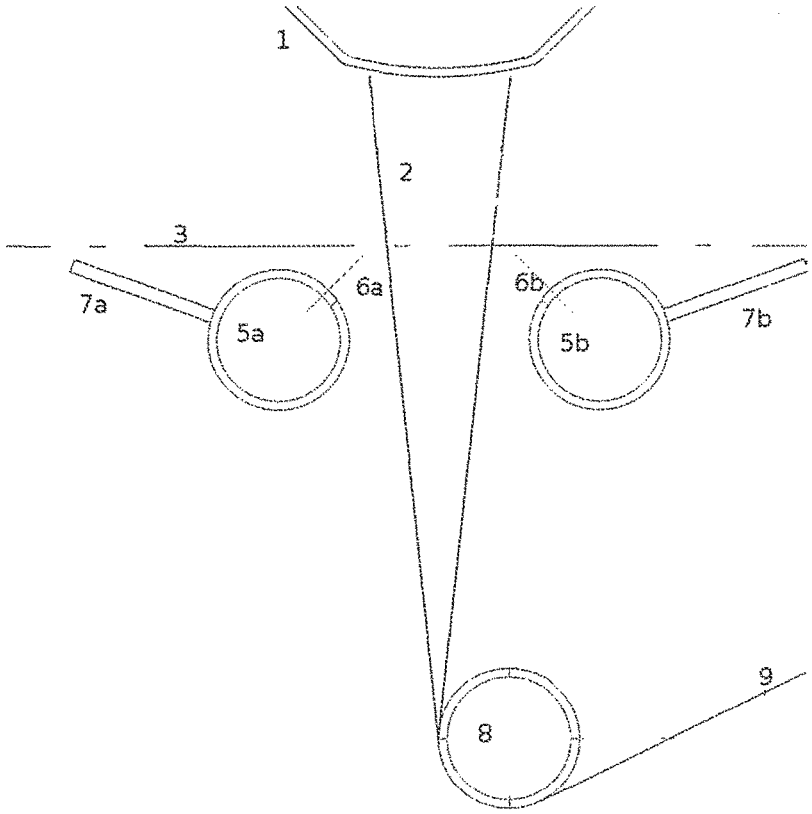
FIG. 2 shows an arrangement as illustrated in FIG. 1 and shows additionally diverting elements 7*a* and 7*b*, which minimise an inflow of coagulation liquid from the spinning bath to the entry region, such that coagulation liquid that has flowed in freshly is preferentially present at the entry region. A deflection pulley 8 for deflecting the coagulated spinning yarns 9 is also shown.

It has surprisingly be found that an effective solidification and coagulation system for the dry-jet wet spinning method is formed as follows and can be used for the shaping of cellulosic materials and additives. A composition of cellulose 12.9%, amine oxide (NMMO—N-methylmorpholine N-oxide) 76.3%, and water 10.8% was used as material to be shaped and fed to the spinning device.

The spinning material stream is first divided between individual spinning positions or spinning groups and is fed to the individual spinning positions. The material is pressed under pressure through the extrusion openings and shaped into the shaped articles, which are additionally dawn in an air gap between the extrusion openings and the coagulation bath. Drawing of the shaped bodies is not always necessarily desirable and also does not always have to be performed on the extrudates.

The shaped article is introduced into a coagulation bath. In this first coagulation or precipitation bath, a pre-solidification, partial solidification or total solidification of the shaped article is carried out, wherein different compositions of the coagulation bath can be used for pre-solidification, partial solidification or total solidification. The pre-solidified, partially solidified or totally solidified drawn shaped article obtains its desired product properties in the first coagulation bath and is brought via a deflection and transport device located in the first bath from the first bath via a further deflection device into a second bath arranged therebeneath for further treatment of the shaped article.

The treatment in the first bath may consist of the fact that a coagulation, washing, evaporation, solvent exchange, impregnation, or crosslinking of the shaped article with different chemicals and reagents may occur.

A further treatment in the second bath may consist of the fact that a coagulation, washing, evaporation, solvent exchange, impregnation, or crosslinking of the shaped article with different chemicals and reagents may occur. In the first bath, the coagulation liquid is fed to the shaped article close to the article and the surface. The first bath is characterised in that only a quantity of liquid equal to that dragged out from the first bath with the precipitation product is fed to the precipitation or treatment or coagulation bath. The precipitation or treatment or coagulation bath can be guided after the first bath via pinching devices or wipe-off lips, whereby excess liquid is thus fed back into the first bath (drained off) before the precipitation product is fed to the second bath for continuous further processing. The second bath is usually used for washing, and the washed, treated produced precipitation product is discharged from the second bath via a deflection device attached therein. The process can be expanded by a number of washing or treatment stages as desired.

All deflection pulleys in the baths and the coagulation liquid mouths can be movable or fixed independently of one another, in particular can be movable in order to adjust the treatment times in the first and/second bath in a flexible manner.

The inflow to the first coagulation bath may have an opening for controlling the influx of coagulation liquid into the coagulation bath, wherein an overflow caused by a regulator is fed to the second coagulation bath. This overflow can be adjusted on the one hand via a free overflow edge or by means of a control butterfly valve.

TABLE

| | | Example | | | |
|---|---|---|---|---|---|
| | | 1 | 2 | 3 | 4 |
| Method parameter | | | | | |
| Spec. NMMO-INPUT (ratio of NMMO to cell in the spinning jet) | * | 9.83 | 6.12 | 5.02 | 5.87 |
| discharge rate | m/min | 38.00 | 32.00 | 37.00 | 37.00 |
| hole density | hole per $mm^2$ | 2.70 | 2.70 | 2.70 | 2.70 |
| fresh bath temperature | ° C. | 26.00 | 18.00 | 22.00 | 20.00 |
| fresh bath concentration | % | 20.3% | 17.5% | 8.7% | 0.0% |
| coagulation bath concentration | % | 24.9% | 29.4% | 34.9% | 40.5% |
| Liquor ratio | | | | | |
| liquor ratio of drag stream to cellulose stream | | −5 | 22.60 | 11.90 | 10.80 |
| liquor ratio of overflow stream to cellulose stream | | −135 | * | * | * |
| total liquor | | 140.00 | 22.60 | 11.90 | 10.80 |
| Ratio of NMMO cellulose | | | | | |
| Spec. NMMO-OUTPUT (NMMO removed through cable and drag stream divided by cellulose stream | | 1.39 | 8.84 | 5.57 | 5.87 |
| NMMO OUTPUT/INPUT ratio | | 0.14 | 1.44 | 1.11 | 1.00 |
| Fibre data | | | | | |
| titre | dtex | 1.31 | 1.33 | 1.29 | 1.38 |
| variation coefficient of the titre | % | 13.90 | 10.70 | 15.90 | 24.80 |
| spinning behaviour | 1 . . . good<br>5 . . . poor | 1-2 | 1-2 | 2 | 4 |
| wet abrasion value | | 695.00 | 230.00 | 189.00 | 312.00 |

Example 1 (See Also Table)

A spinning solution with an NMMO:cellulose ratio of 9.83 ("spec. NMMO-INPUT") was fed to a spinneret. The flat filament curtain extruded via the spinneret with a hole density of 2.7 holes per $mm^2$ was conveyed through the coagulation bath with a discharge rate of 38 m/min.

At the end of the exchange path, the filament curtain was bundled to form a compact filament bundle by means of a ceramic bundling roll.

Fresh liquid with an NMMO concentration of 20.3% and a temperature of 26° C. was fed.

Due to the forced bundling of the plane filament curtain into a compact fibre cable at the end of the exchange path, hardly any coagulation bath could be dragged out from the coagulation tank, and therefore significantly more fresh liquid than could be removed by the forcibly bundled yarn bundle had to be fed in order to achieve the desired NMMO concentration in the coagulation bath of 23.1%.

The quantity of fresh liquid to the coagulation bath and the overflow quantity from the coagulation bath were measured and related to the cellulose stream exiting from the coagulation bath.

The "liquor ratio of drag stream to cellulose stream" was calculated from the difference between fresh liquid quantity [kg/h] and overflow quantity [kg/h] divided by the cellulose stream [kg/h].

It was possible to establish the "liquor ratio of overflow stream to cellulose stream" from the division of overflow stream by cellulose stream.

The "total liquor" was established from the summation of the above-mentioned partial liquors:

The overflow stream was subjected to weight-analytical measurement in order to determine the NMMO content [% by weight].

To establish the NMMO quantity removed by the drag stream and yarn bundle, the NMMO overflow quantity (calculated from the overflow stream quantity [kg/h] and NMMO content [% by weight]) was subtracted from the NMMO quantity fed to the system by means of fresh bath and spinning jet.

The NMMO quantity removed by drag stream and yarn bundle was then related to the removed quantity of cellulose in order to obtain the "spec. NMMO-OUTPUT".

The quotient from "spec. NMMO-OUTPUT" by "spec. NMMO-INPUT" ultimately represents how much NMMO is discharged from the spinning system via the fibres in relation to the quantity of NMMO introduced by the spinning jet, wherein more gentle coagulation conditions tend to be produced with higher values.

The spinning behaviour and the titre variance were satisfactory. Examinations of the fibrillation behaviour on the basis of the wet abrasion value gave values typical for standard lyocell fibres.

Example 2

A spinning solution with an NMMO:cellulose ratio of 6.12 ("spec. NMMO-INPUT") was fed to a spinneret. The flat filament curtain extruded as in Example 1 was conveyed through the coagulation bath at a discharge rate of 32 m/min.

At the end of the exchange path, the plane filament curtain was not bundled, but was conveyed as a plane curtain via guide elements and thus supplied to the next treatment steps.

Fresh liquid with an NMMO concentration of 17.5% and a temperature of 18° C. was supplied.

Since the plane filament curtain at the end of the exchange path was guided from a bath without bundling, coagulation liquid was able to be dragged out in sufficient quantities from the coagulation tank and the same quantity of fresh liquid supplied in order to achieve the desired NMMO concentration in the coagulation bath of approximately 30% (measured: 29.4%).

Figure 3:
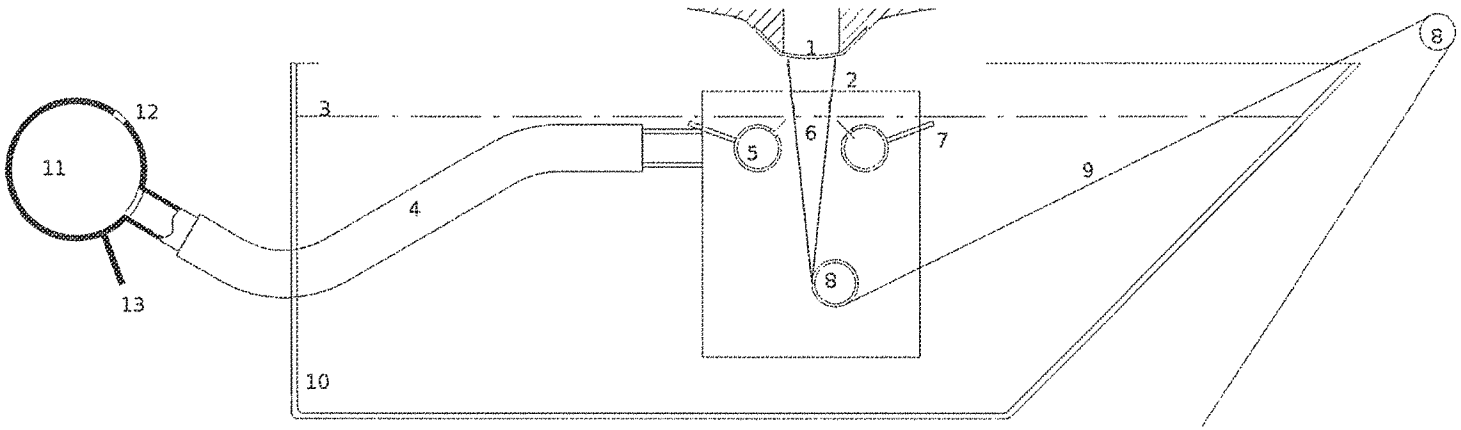
FIG. 3 shows an arrangement as illustrated in FIG. 2 and shows the coagulation liquid line 4 and the tank 10 of the spinning bath. The coagulation liquid line 4 is connected to a liquid fill level regulator 11. The regulator has an opening 12, via which the fill level 3 in the spinning bath 10 is regulated. The regulator is rotatable via an arm 13, whereby the height of the opening 12 and therefore the fill level 3 can be adjusted.
Figure 4:
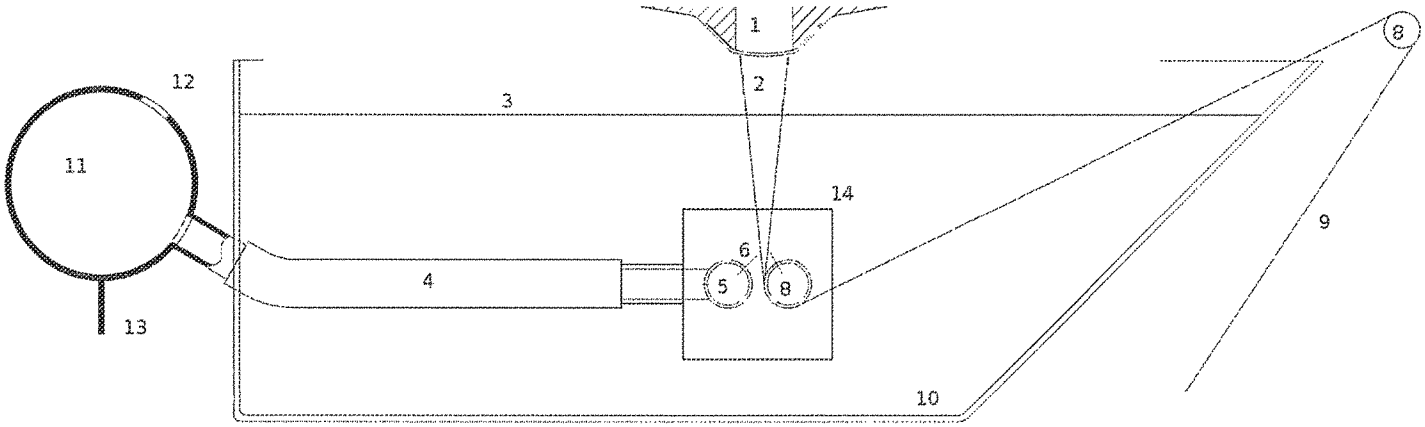
FIG. 4 shows an arrangement as illustrated in FIG. 3, wherein the distributing pipes 5 of the feed line—fixed commonly in a height adjustable assembly device 14—can be positioned lower in the tank. In this embodiment, a distributing pipe is simultaneously equipped with a deflection pulley 8.
Figure 5:
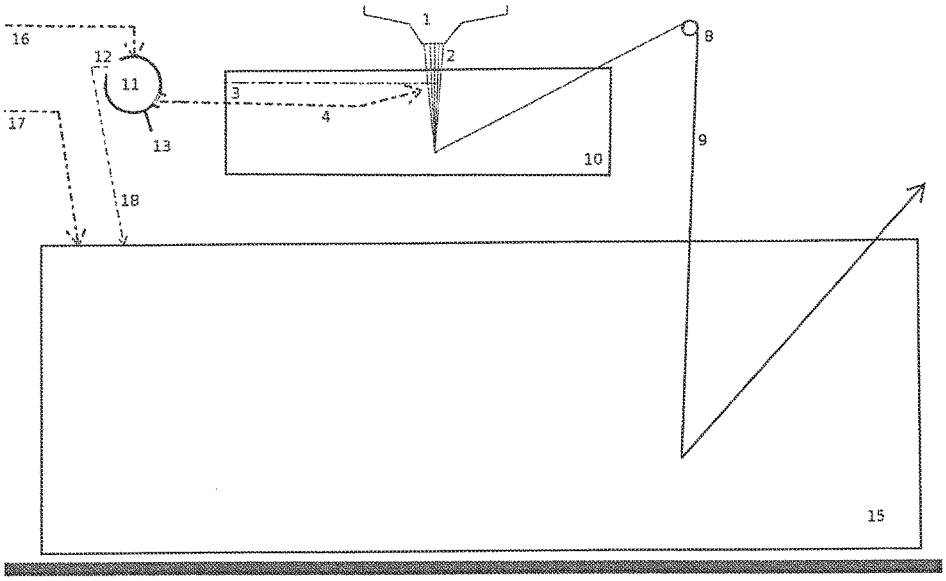
FIG. 5 schematically shows a spinning bath device formed from two baths or tanks (10 and 15). A first solidification of the spinning yarns 2 is undertaken in the tank 10. The coagulated spinning yarns 9 are conveyed via deflection pulleys 8 into the tank 15, in which, due to the presence of coagulation liquid, which may be different from the coagulation liquid of the tank 10, the bundled yarns 9 can be further solidified or washed. The liquid fill level regulator 11 is supplied by a line 16 with coagulation liquid. The liquid fill level regulator, via the line 4, thus serves as a liquid inlet for the tank 10. The tank 15 may have a separate liquid inlet 17. The opening 12 in the regulator, which regulates the fill level in the tank 10, may lead into the tank 15 in the event of overflow in order to additionally or alternatively supply said tank with coagulation liquid.
Figure 6:
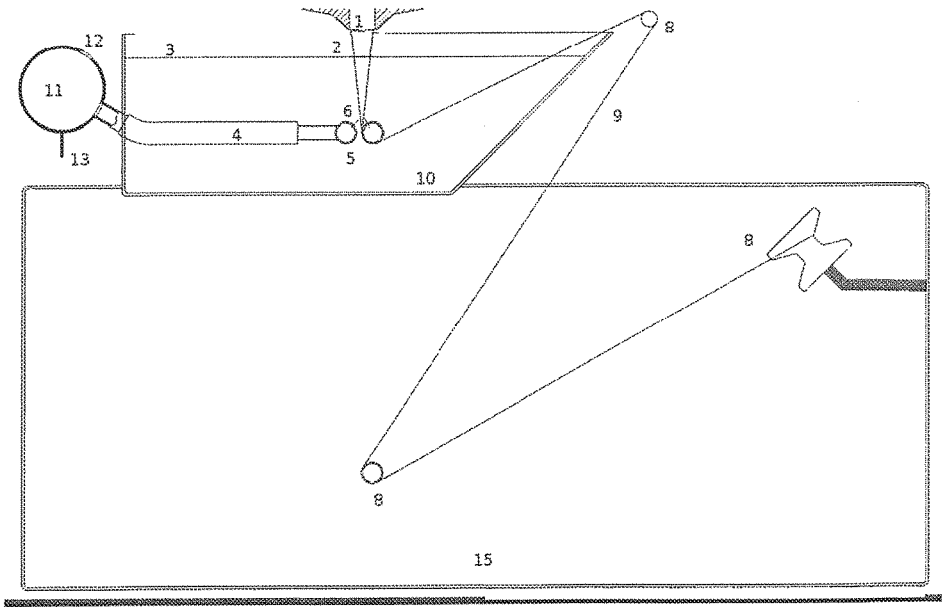
FIG. 6 shows a spinning bath device formed from two baths or tanks (10 and 15) as described in FIG. 5 with the first tank 10 as shown in FIG. 4.

The supplied quantity of fresh liquid and the dragged quantity of coagulation liquid were able to be balanced by the test arrangement as illustrated in FIG. 3, and there was no overflow from the coagulation bath.

The quantity of fresh liquid was measured and related to the cellulose stream exiting from the coagulation bath.

The "liquor ratio of drag stream to cellulose stream" was calculated from the quantity of fresh liquid [kg/h] divided by the cellulose stream [kg/h].

Since there was no overflow stream, the "liquor ratio of overflow stream to cellulose stream" was calculated to be zero. The "total liquor" therefore corresponded to the liquor ratio of drag stream to cellulose stream.

Since there was no overflow stream, the quantity of NMMO removed by drag stream and yarn bundle corresponded to the quantity of NMMO supplied to the system by means of fresh liquid and spinning jet.

As a result, the quantity of NMMO removed by drag stream and yarn bundle was related to the removed quantity of cellulose in order to obtain the "spec. NMMO-OUTPUT".

The quotient from "spec. NMMO-OUTPUT" by "spec. NMMO-INPUT" ultimately represents how much NMMO is discharged from the spinning system via the fibres in relation to the quantity of NMMO introduced by the spinning jet, wherein more gentle coagulation conditions tend to be produced at higher values.

The spinning behaviour and the tire variance were very satisfactory:

Examinations of the fibrillation behaviour on the basis of the wet abrasion value gave much better (lower) values than would be expected with standard lyocell fibres.

Example 3

A spinning solution with an NMMO:cellulose ratio of 5.02 ("spec. NMMO-INPUT") was fed to a spinneret. The flat filament curtain extruded as in Example 1 was conveyed through the coagulation bath at a discharge rate of 37 m/min.

Figure 7:
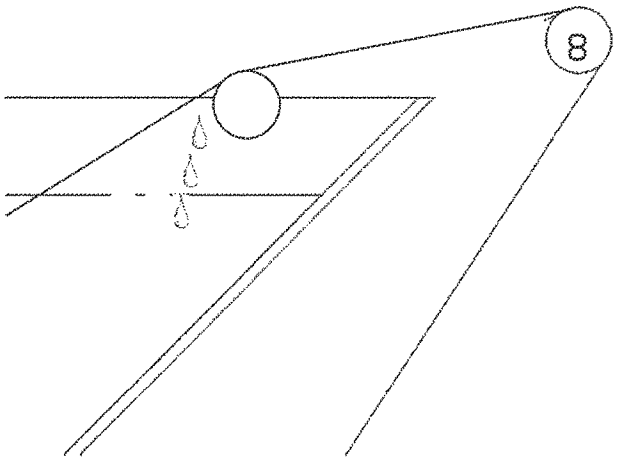
FIG. 7 shows a wipe-off and deflection device (wipe-off lips) for shaped articles, which has vertically adjustable and height-adjustable deflection pulleys (which may be fixed or rotating) in order to avoid drag losses of the bath liquid or to adjust a desired measure. This deflection pulley is positioned above the bath, such that liquid draining off is fed back into the bath. This device can be provided for the coagulation bath and/or for the washing bath.

At the end of the exchange path, the plane curtain was conveyed via guide elements and in accordance with FIG. 7 was removed from the coagulation bath via a wipe-off device, which feeds some of the dragged coagulation bath back into the coagulation tank.

Fresh liquid with an NMMO concentration of 8.7% and a temperature of 22° C. was supplied.

It was possible for coagulation liquid to be dragged in sufficient quantities from the coagulation tank and for the same quantity of fresh liquid to be supplied in order to reach the desired NMMO concentration in the coagulation bath of approximately 35% (measured: 34.9%).

The supplied quantity of fresh liquid and the dragged quantity of coagulation liquid were able to be balanced by the test arrangement as illustrated in FIG. 3 in combination with FIG. 7, and there was no overflow from the coagulation bath.

The quantity of fresh liquid was measured and related to the cellulose stream exiting from the coagulation bath.

The liquor ratio of drag stream to cellulose stream was calculated from the quantity of fresh liquid [kg/h] divided by the cellulose stream [kg/h].

Since there was no overflow stream, the liquor ratio of overflow stream to cellulose stream was calculated to be zero.

The total liquor therefore corresponded to the liquor ratio of drag stream to cellulose stream.

The spinning behaviour and the tire variance were satisfactory:

Since there was no overflow stream, the quantity of NMMO removed by drag stream and yarn bundle corresponded to the quantity of NMMO supplied to the system by means of fresh bath and spinning jet.

As a result, the quantity of NMMO removed by drag stream and yarn bundle was related to the removed quantity of cellulose in order to obtain the "spec. NMMO-OUTPUT".

The quotient from "spec. NMMO-OUTPUT" by "spec. NMMO-INPUT" ultimately represents how much NMMO is discharged from the spinning system via the fibres in relation to the quantity of NMMO introduced by the spinning jet, wherein more gentle coagulation conditions tend to be produced at higher values.

Examinations of the fibrillation behaviour on the basis of the wet abrasion value gave further improved (lower) values than was the case in Example 2.

Example 4

A spinning solution with an NMMO:cellulose ratio of 5.87 ("spec. NMMO-INPUT") was fed to a spinneret. The test was carried out as in Example 3, however the plane filament curtain at the end of the exchange path was removed from the coagulation bath in accordance with FIG. 8 via two wipe-off devices (upper and lower), which feed some of the dragged coagulation bath back into the coagulation tank. Pure water at a temperature of 20° C. was supplied to the coagulation bath.

It was possible for coagulation liquid to be dragged in sufficient quantities from the coagulation tank and for the same quantity of fresh liquid to be supplied in order to reach the desired NMMO concentration in the coagulation bath of approximately 40% (measured: 40.5%).

Figure 8:
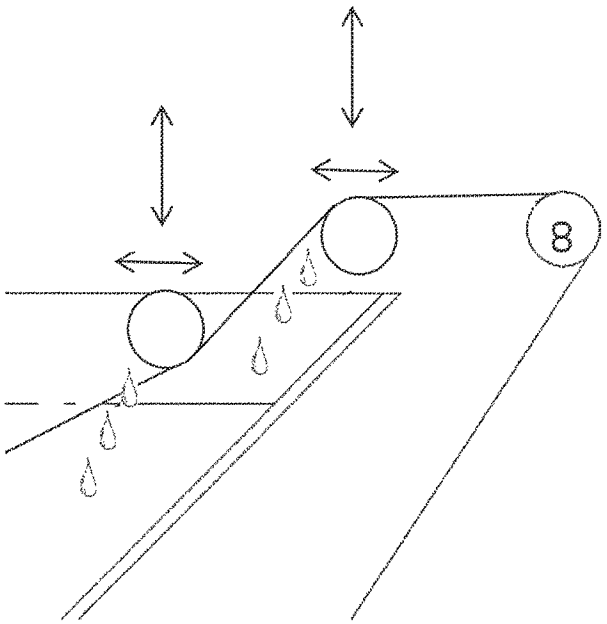
FIG. 8 shows a wipe-off and deflection device for shaped articles similarly to that shown in FIG. 7, with two vertically adjustable and height-adjustable deflection pulleys (marked by vertical and horizontal double-headed arrows) above the bath instead of one such deflection pulley.

The supplied quantity of fresh liquid and the dragged quantity of coagulation liquid were able to be balanced by the test arrangement as illustrated in FIG. 3 in combination with FIG. 8, and there was no overflow from the coagulation bath.

The quantity of fresh liquid was measured and related to the cellulose stream exiting from the coagulation bath.

The liquor ratio of drag stream to cellulose stream was calculated from the quantity of fresh liquid [kg/h] divided by the cellulose stream [kg/h].

Since there was no overflow stream, the liquor ratio of overflow stream to cellulose stream was calculated to be zero. The total liquor therefore corresponded to the liquor ratio of drag stream to cellulose stream.

Since there was no overflow stream, the quantity of NMMO removed by drag stream and yarn bundle corresponded to the quantity of NMMO supplied to the system by means of fresh bath and spinning jet.

As a result, the quantity of NMMO removed by drag stream and yarn bundle was related to the removed quantity of cellulose in order to obtain the "spec. NMMO-OUTPUT".

The quotient from "spec. NMMO-OUTPUT" by "spec. NMMO-INPUT" ultimately represents how much NMMO is discharged from the spinning system via the fibres in relation to the quantity of NMMO introduced by the spinning jet, wherein more gentle coagulation conditions tend to be produced at higher values.

The spinning behaviour and the titre variance were sufficient.

Examinations of the fibrillation behaviour on the basis of the wet abrasion value again gave good (low) values, however worse than in Example 2 and Example 3.

The invention claimed is:

1. A coagulation bath capable of holding a coagulation liquid, the bath comprising:

at least one coagulation liquid inlet arranged beneath a level of the coagulation liquid;

an entry region configured for receiving shaped articles that are solidified in the coagulation bath; and a deflection element below the level of the coagulation liquid in the coagulation bath that re-orients the shaped articles solidified in the coagulation bath, wherein the coagulation liquid inlet has one or more openings that are arranged beneath the entry region and face the shaped articles entering the coagulation bath, such that the coagulation liquid exiting from the at least one coagulation liquid inlet flows directly against the shaped articles during operation.

2. The coagulation bath according to claim 1, wherein at least one of the openings is arranged approximately centrally in the coagulation bath.

3. The coagulation bath according to claim 1, wherein the coagulation liquid inlet includes a plurality of openings, wherein the plurality of openings are aligned horizontally.

4. The coagulation bath according to claim 1, wherein at least one of the openings is positioned at a distance of 1 mm to 50 mm from the shaped articles transported through the coagulation bath.

5. The coagulation bath according to claim 1, wherein the coagulation bath inlet includes a plurality of openings, and the plurality of openings are directed at an incline relative to the shaped articles, at least partially against a direction of movement of the shaped articles through the coagulation bath, in a direction of a surface of the coagulation liquid or are arranged horizontally.

6. The coagulation bath according to claim 1, further comprising a liquid line with the one or more openings located beneath the level of the coagulation liquid and a liquid fill level regulator outside of the coagulation bath, which is hydraulically connected via the liquid line to the coagulation liquid, wherein the liquid fill level regulator has an opening at a predefined level, whereby the liquid level in the coagulation baths is established by a vessel communicating with the externally arranged liquid fill level regulator.

7. The coagulation bath according to claim 6, wherein the height of the opening in the liquid fill level regulator is adjustable.

8. The coagulation bath according to claim 6, wherein the liquid fill level regulator has a liquid inlet.

9. The coagulation bath according to claim 6, wherein the liquid line leads into the interior of the coagulation bath and the one or more openings are located in the interior of the coagulation bath.

10. A method for solidifying fluid shaped articles, comprising: guiding the fluid shaped articles into the coagulation bath of claim 1 with a coagulation liquid; and supplying the coagulation liquid into the coagulation bath so that the coagulation liquid flows against the fluid shaped articles for the purpose of exchanging solvent and non-solvent between the fluid shaped articles and the coagulation bath.

11. The method according to claim 10, wherein the fluid shaped articles, before solidification in a coagulation liquid, are formed from dissolved cellulose.

* * * * *